United States Patent [19]

Langhoff et al.

[11] Patent Number: 4,602,992

[45] Date of Patent: Jul. 29, 1986

[54] COAL HYDROGENATION PROCESS WITH INTEGRATED REFINING STAGE

[75] Inventors: Josef Langhoff, Dinslaken; Eckard Wolowski, Mülheim; Frank Mirtsch, Bottrop, all of Fed. Rep. of Germany

[73] Assignee: Ruhrkohle Aktiengesellschaft, Essen, Fed. Rep. of Germany

[21] Appl. No.: 778,759

[22] Filed: Sep. 20, 1985

Related U.S. Application Data

[63] Continuation of Ser. No. 624,106, Jun. 25, 1984, abandoned.

[30] Foreign Application Priority Data

Jun. 24, 1983 [DE] Fed. Rep. of Germany ..... 3322730

[51] Int. Cl.[4] ..... C10G 1/06; C10G 1/00

[52] U.S. Cl. ..... 208/412; 208/417; 208/418

[58] Field of Search ..... 208/10, 8 LE

[56] References Cited

U.S. PATENT DOCUMENTS

| | | | |
|---|---|---|---|
| 4,222,844 | 9/1980 | Nizanoff | 208/10 |
| 4,266,083 | 5/1981 | Huang | 208/10 |
| 4,283,267 | 8/1981 | Maa et al. | 208/10 X |
| 4,400,263 | 8/1983 | Kydd | 208/10 |
| 4,473,460 | 9/1984 | Kuerten et al. | 208/10 |

*Primary Examiner*—William G. Wright

*Attorney, Agent, or Firm*—Nils H. Ljungman

[57] ABSTRACT

In accordance with the invention, during hydrogenation by means of sump phase hydrogenation followed by gas-phase hydrogenation, the high boiling fractions are separated from the lower boiling vapor fractions, after leaving the hot precipitation head, by partial condensation in an intermediate precipitator with the result that the gas-phase reactor has a better service life and optimum reaction conditions can be provided. The improved process results in an improved quality of solvent for the sump phase hydrogenation.

3 Claims, 5 Drawing Figures

GASES TO SCRUBBER
REFINED PRODUCTS FOR ATMOSPHERIC DISTILLATION
8
7
350-420°C
150-290 bar
QUENCHING GAS
6
5
4
SOLVENT
3
FLASH EVAPORATION (DEPRESSURIZATION)
TO VACUUM DISTILLATION
2
1
≤480°C
150-300 bar
MASH AND HYDROGENATION GAS

COAL HYDROGENATION PROCESS WITH INTEGRATED REFINING STAGE

This application is a continuation of the U.S. Application Ser. No. 06/624,106, filed on June 25, 1984, now abandoned.

BACKGROUND OF THE INVENTION

1. Field of the Invention

The invention concerns the production of liquid hydrocarbons by the hydrogenation of coal whereby, in one working operation, refined products are produced with comparably lower boiling points.

2. Description of Prior Art

The crude coal-oils produced by the sump phase hydrogenation of coal or high-boiling products stemming from coal, such as tars, pitch, etc., require additional processing steps in order to arrive at refined liquid hydrocarbons which are stable in storage. In order to increase the thermal efficiency and the economy of the entire process, it is advantageous to arrange the sump phase hydrogenation and the refining stages in series. This is because the processing parameters (pressure, temperature) required for the refining stage result automatically from the sump phase hydrogenation.

Since, in the refining of crude coal-oils from the sump phase hydrogenation, there also occurs a transformation to lower boiling fractions, it is possible to optimize the entire process with regard to the desired product qualities. For an economical processing operation with a high degree of availability of the entire installation, both the service life as well as the optimum reaction conditions of the solid bed catalyst in the refining stage play a decisive role. The quality of the solvent required for mashing the coal is of importance.

Several procedures are known for the direct arranging in series of sump phase hydrogenation and gas phase hydrogenation (solid bed catalyst) in the production of refined liquid hydrocarbons from coal, products which originate from coal (pitches, tars, etc.) and from heavy oils which stem from petroleum. In the "Combination-Hydrogenation Chamber" by W. Urban (Journal: Erdöl und Kohle", 8th year, Nov. 1955, No. 11, pages 780–782), the hydrocarbons, which are produced in the sump phase reactors and which contain low-, medium- and high-boiling point fractions, are conveyed at about 430° C. and about 300 bars over gas phase reactors with a solid bed catalyst filling. This process, which is presently known by the name VEBA-COMBI-CRACKING, was also carried over to coal hydrogenation (Journal: ENERGIE, year 34, No. 6, June 82, pages 172–173). In the combination process of L. Raichle and W. Krönig (German Laid Open patent application No. 26 54 635), the coal-oil vapors produced in the sump phase hydrogenation are divided into two parts. In the process, part is taken over the gas phase reactors with a lump catalyst whereby, after a subsequent separation of liquid and gas, and distillation, the low boiling point fractions are led away as products and the higher boiling point fractions (hydrogenated medium and light oils) form the solvent for the coal-mashing operation. After leaving the sump phase hydrogenating unit (hot precipitator), another fraction is condensed-out directly and provides the required medium oil and heavy oil fractions for mashing the coal. In this way, there is produced a solvent which comprises a mixture of hydrogenated (in the gas phase reactor) and non-hydrogenated medium and heavy oils. In this regard, this process differs from other hydrogenating processes (as for example, the EXXON process) in which the entire solvent is hydrogenated. However, the Raichle and Krönig process is disadvantageous in that the directly condensed-out coal-oil vapors also contain a considerable amount of the light oil produced, which results in an unrefined end product.

All the above-mentioned processes suffer from the drawback that the crude hydrocarbon vapors taken via the gas phase reactors with solid bed catalysts contain a large portion of high boiling oils which lead to increased coke formation and thus reduce the service life of the lumpy catalyst.

It has been suggested that for certain applications, an intermediate precipitator can be utilized and such intermediate precipitators are well known in pure sump phase hydrogenation processes which do not incorporate subsequent gas-phase hydrogenation. In such applications, the intermediate precipitator is located after the hot precipitator. However, in such applications, the intermediate precipitator is so operated with regard to temperature and pressure that there results in the intermediate precipitator sump an amount of solvent which comprises medium and heavy oil and which is necessary so that when the sump is admixed as a partial stream with another partial stream stemming from a vacuum column, the solvent self-sufficiency of the sump phase hydrogenation process is ensured. (U. Bönisch and B. Strobel: German Laid Open patent application No. DE 30 22 158). Because the head products of the intermediate precipitator contain only product oil comprising light and medium oils (and amounts of heavy oil, if such be the case), the otherwise usual distillation phase for separating product and solvent oils becomes superfluous. It is, however, disadvantageous that an amount of light oil which is fed back again in the solvent to the sump phase hydrogenator is also drawn-off in the intermediate precipitator sump.

OBJECTS OF THE INVENTION

It is, therefore, an object of the invention to reduce the amount of high boiling point oils in the crude hydrocarbon vapors prior to the gas phase hydrogenation, whereby the gas phase reactor has a better service life and optimum reaction conditions can be provided. It is also an object of the invention to provide an improved process which generates an improved quality of solvent for the sump phase hydrogenation.

SUMMARY OF THE INVENTION

The invention provides an improvement to a coal hydrogenation process in which the coal oils from the sump phase hydrogenation are subjected to a subsequent gas phase hydrogenation at a predetermined reaction temperature to obtain predetermined, refined products, the improvement comprising the stepts of: subdividing the sump phase hydrogenation coal oil by means of partial condensation in an intermediate precipitator at a predetermined temperature under process pressure into a high boiling liquid fraction and a lower boiling vapor-forming fraction prior to the gas phase hydrogenation; passing said vapor forming fraction to said subsequent gas phase hydrogenation; and drawing off said high boiling liquid fraction for use at least in part, in said coal hydrogenation process as a solvent.

BRIEF DESCRIPTION OF THE DRAWINGS

The above as well as other features and advantages of the present invention can be readily appreciated through consideration of the detailed description of the invention in conjunction with accompanying drawings in which.

DESCRIPTION OF THE PREFERRED EMBODIMENT

Figure 1:
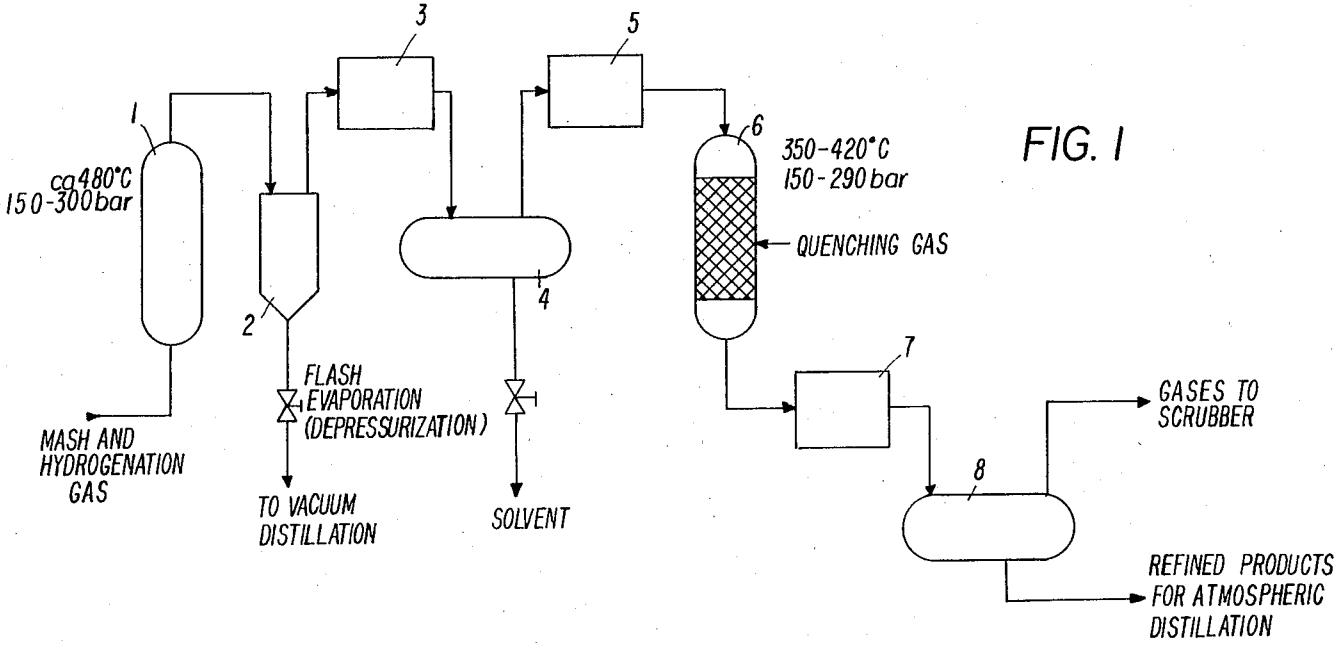
FIG. 1 is a flow diagram illustrating the present improvement to a coal hydrogenation process.

In accordance with the invention, the drawbacks of the conventional techniques are avoided by arranging for the crude coal-oils from the sump phase hydrogenator to be subdivided into a high boiling liquid fraction and a low boiling vapor fraction, after leaving the hot precipitator head, by partial condensation in an intermediate precipitator. The lower boiling coal-oil vapors, which have traveled via the gas phase reactor, comprise light and medium oils and, if such be the case, a comparatively small amount of light-heavy oil. This distribution can be varied by varying the temperature of the intermediate precipitator. By this means, it is possible to combine sump phase hydrogenation with gas phase hydrogenation in a single operating process, so that only the crude-oils which contain only a fraction of heavy oil and which have a tendency towards a low boiling point are passed through the gas phase reactors. The tendentiously high boiling crude coal oils are largely drawn off before the gas phase reactor and serve as part of the solvent for producing the coal mash. The consequence is that, on the one hand, the gas phase reactor has a better service life as well as providing optimum reaction conditions for producing (partially) refined and low boiling products and, on the other hand, is freed of the coal-oil fraction (especially heavy oil) which is required as the solvent for the coal mashing operation. Moreover, optimum reaction conditions can be set in for a catalyst with a limited boiling range for the application product. The charge for the gas phase reactor thus falls within the desired boiling range. The entire process can be optimized in a way such that, on the one hand, optimum refining and conversion of crude coal oils (light oil, medium oil and some heavy oil) to refined hydrocarbons with a low boiling range is effected and that, on the other hand, the service life and the reaction conditions for the catatlyst in the gas phase reactor are optimized. Furthermore, for the case in which more coal-oils pass through the gas phase reactor than corresponds to the amount of the product, only light and medium oils, as well as the lower boiling fractions of the heavy oil are hydrogenated in the gas-phase reactor. As a result, on the one hand, the catalyst is conservatively loaded and, on the other hand, there is produced a hydrogenated solvent portion which consists of medium oil and light heavy oil fractions. This indicates that the solvent quality for the hydrogenation process is largely determined by the type and amount of the medium oil and, if such be the case, of the light-heavy oil as, for example, donator action of the relatively easily hydrogenatable medium oils and the light heavy oil fractions.

The part of the solvent thus produced and fed back into the coal mash thus consists, on the one hand, of the hydrogenated solvent oil (free of heavy oil) with a higher boiling range and, on the other hand, of the higher boiling intermediate precipitator sump product which is not hydrogenated. By this means, an improved solvent quality which is not hydrogenated, is obtained for the hydrogenating process.

Because the liquid portion in the intermediate precipitator still contains small amounts of light oil, the light oil can be largely separated out, if need be, by stripping with hydrogen-containing gases and by partially evaporating the liquid portion and/or by flash evaporation or the like, and added to the charge for the gas phase hydrogenation operation.

Various examples of the hydrogenation process of the invention are presented in the following. Considering FIG. 1, the products from the sump phase hydrogenator 1 are separated in the hot precipitator 2 at about 450° C. into a liquid/solid phase (sump) and a gas/vapor phase (head). This gas/vapor phase, which contains the actual coal oils, is partially cooled in the heat-exchangers 3, as a result of which the major portion of the tendentiously high boiling fractions in the coal oils condenses out. The separation of the liquid phase, on the one hand, and the gas/vapor phase, on the other hand, occurs in the intermediate precipitator 4 at approximately 320° to 420° C.

The temperature of the intermediate precipitator 4, which determines the thermodynamic equilibrium and thus the separation of the coal oil into a lower boiling vapor phase and a higher boiling liquid phase, can be varied by an alternative arrangement of the charge-product heat-exchangers 3 which recover a large part of the waste heat from the products.

There are six variants of the process to be considered in order, as a function of the amounts and boiling ranges of the coal-oil product from the sump phase hydrogenation, to set the optimum reaction conditions for the gas phase hydrogenation:

Procedure (a)

The products from the hot precipitator head are cooled in the heat exchanger 3 to the reaction temperature of the gas phase reactor 6. In the process, a considerable part of the heavy oil (as, for example, 70%) from the hot precipitator head-product is obtained in the vapor form. Almost all the light oil and the predominating part of the medium oil likewise occur in the vapor form.

By this procedure, quantitatively more products are caused to pass through the gas phase reactors 6 than correspond to the end products, that is, part of the refined products (medium and heavy oils) are used as part of the hydrogenated solvent.

Example 1

Based on 100 kg of (water-free) coal in the sump phase reactors 1 (480° C., 300 bars) and 150 kg of solvent (50% medium oil, 50% heavy oil) there is obtained in the intermediate precipitator 4 at a temperature of 390°–400° C. the following product distribution:

The sump phase from the intermediate precipitator contains 15.8 kg of oils (1.5% light oil, 24% medium oil, 74.5% heavy oil) which are recirculated as part of the solvent. The head phase of the intermediate precipitator 4 (charge for the gas phase reactor 6) consists of the hydrogenated gas from the sump phase hydrogenation and 126 kg of oil vapor (14.5% light oil, 55.5% medium oil, 30% heavy oil). The crude coal oils are prerefined by refining on a solid bed catalyst in the gas phase reactor 6 at 390° C. and 280 bars and partially converted to lower boiling ranges. With a specific catalyst loading of 1 kg of oil/1 kg of catalyst.h, there is obtained a product distribution of approximately 30% light oil, 43.5% medium oil and 26.5% heavy oil. The coal oils from the gas phase reactor 6 are condensed-out in the cooler 7 and separated from the residual gases in the precipitator 8. In a subsequent distillation, the prerefined coal-oils are separated into gasoline, medium oil and heavy oil. As a product, all the gasoline and 22% of the medium oil are given off. All of the heavy oil and the rest of the medium oil (78%) are recirculated as part of the solvent which is hydrogenated for the coal mashing operation. Based on the total amount of solvent, the hydrogenated solvent is 50%.

Procedure (b)

The hot precipitator head products are cooled in the heat exchanger 3 to an intermediate precipitation temperature which lies below the reaction temperature in the gas phase reactor 6. As a result, a major portion of the heavy oil condenses out. The gas/vapor contains comparatively little heavy oil and thus makes possible optimum reaction conditions for the lumpy catalyst in the gas phase reactor 6. Before entering the gas phase reactor, the gas/vapor phase is heated, by means of the heater 5, to the reaction temperature of the gas phase reactor 6. After leaving the gas phase reactor 6, the products and gases are fed via a cooler 7 to a precipitator 8.

Example 2

With the same charge conditions as in Example 1, the following distribution phases are obtained in intermediate precipitator 4 at a temperature of 330° C.–340° C.: The intermediate precipitator's sump phase contains 70.5 kg of oils (2.5% light oil, 40.5% medium oil, 57% heavy oil) which are recirculated as part of the solvent. The head phase of the intermediate precipitator 4 (charge for the gas phase reactor 6) consists of the hydrogenation gas from the sump phase hydrogenation and 71 kg of oil vapors (23% light oil, 63.5% medium oil, 13.5% heavy oil) which are heated in the heater 5 to the reaction temperature 390° C. of the gas phase reactor 6. By refining on a solid bed catalyst in the gas phase reactor at 390° C. and 280 bars, the crude coal oils are prerefined and partly converted to lower boiling ranges. With a specific catalyst loading of 1 kg oil/1 kg catalyst.h, a product is obtained consisting of approximately 34% light oil, 53.5% medium oil and 12.5% heavy oil. The coal oils from the gas phase reactor 6 are condensed out by cooler 7 and separated in the precipitator 8 from the remaining gases. In a subsequent distillation, the prerefined coal oils are separated into gasoline, medium oil and heavy oil. Given off as a product is all the gasoline and 63.5% of the medium oil. All the heavy oil and the remaining medium oil (36.5%) are recirculated as solvent, which is hydrogenated, to mash the coal. Based on the total solvent, the amount of hydrogenated solvent is 15%.

The subsequent procedures (c–f) constitute modifications of procedure (b). A small amount of light oil is also obtained in the intermediate precipitator sump. In order to prevent this light oil fraction—even if it is small—from being fed back as solvent into the sump phase hydrogenator, the said light oil is, for the most part, separated from the intermediate precipitator sump product and added to the charge for the gas phase hydrogenation.

Procedure (c)

Figure 2:
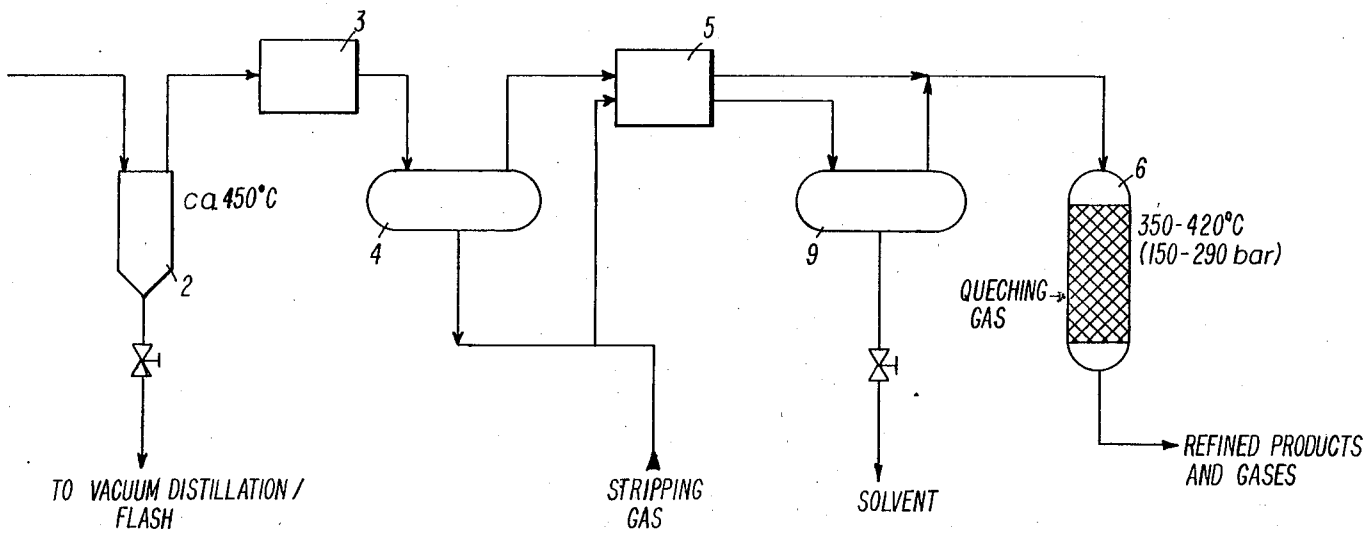
FIG. 2 is a flow diagram illustrating an improved process in which the separation of the light oil from the intermediate precipitator sump product is effected through partial evaporation and/or stripping.

The separation of the light oil from the intermediate precipitator sump product is effected as shown in FIG. 2 by partial evaporation and/or stripping with hydrogenation gas, circuit gas or make-up hydrogen (approximately 97% $H_2$). The evaporating temperature, which lies between the temperatures of the intermediate precipitator and the gas phase reactor, as well as the amount and quality of the stripping gas (such as, for example, hydrogenation-circuit gas, make-up hydrogen (approx. 97% $H_2$)) determine the amount of the low boiling fractions to be evaporated. Heating the intermediate precipitator product can, for example, be effected by means of a heat exchanger 5 (as, for example, by recovering the heat from the waste heat from the hot precipitator head product) or in a heating furnace (for example, parallel to the heater for the intermediate precipitator head products). The gas/oil vapors are separated from the sump product in an additional precipitator 9 and conveyed to the feed for the gas phase hydrogenator.

Example 3

With reference to the numerical date in Example 2, the sump product of intermediate precipitator 4 at 330°–340° C. consists of 70.5% oils, which can also additionally contain about 1.7 kg of light oil. By stripping with 20 $m^3_N$ of make-up hydrogen (97% $H_2$) and heating in furnace 5 at about 390° C., there is obtained in precipitator 9 an amount of oil vapor of about 18 kg (1.3 kg light oil) which is added to the charge in gas phase reactor 6.

Procedure (d)

Figure 3:
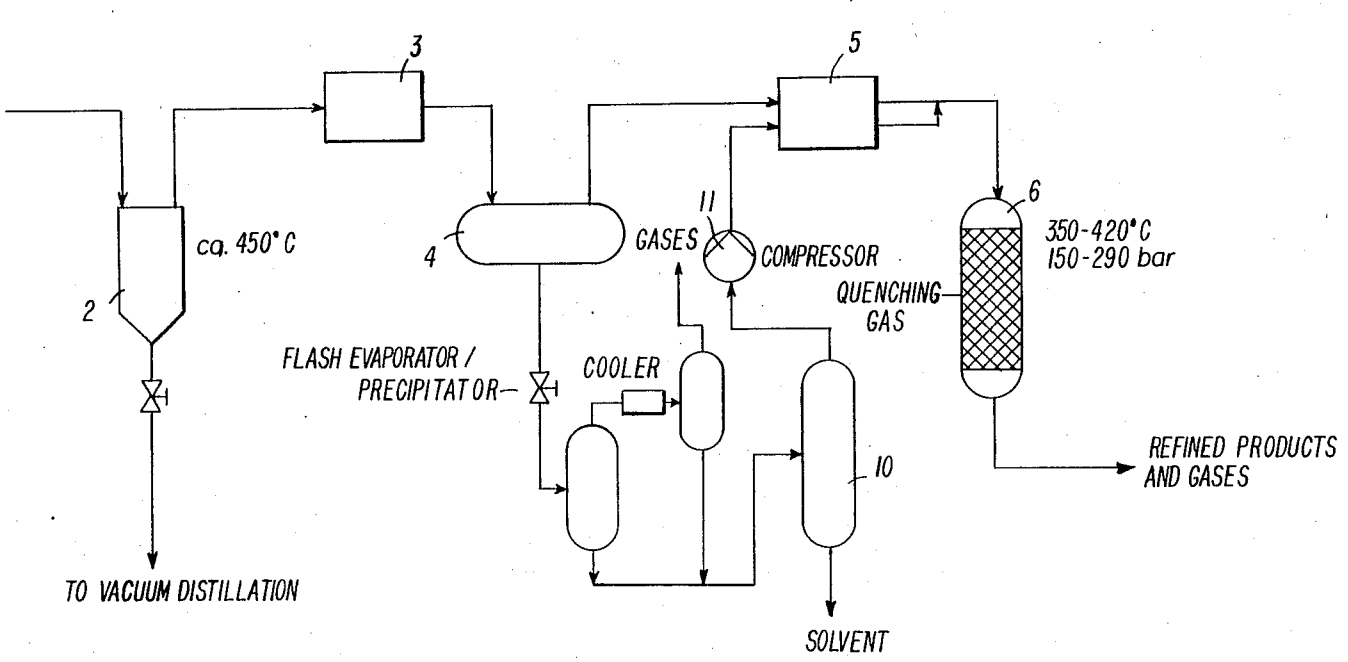
FIG. 3 is a flow diagram illustrating an improved process wherein light oil is separated from the sump product of an intermediate precipitator by the flash evaporation of the sump product with the subsequent distillation of the lower boiling fractions.

The light oil is separated from the sump product of intermediate precipitator 4, as shown in FIG. 3, by the flash evaporation (pressure-relieving) of the sump product with the subsequent distillation separation of the lower-boiling fractions. In distillation column 10, either only light oil or a mixture of light oil and medium oil can be drawn off, compressed again to process pressure by means of a high pressure pump 11, heated and added to the charge for the gas phase hydrogenator. The technological basis for this procedure resides in the fact that complete separation of the light oil takes place in the sump product of the intermediate precipitator. Also, a two-phase flow can be produced as a function of the temperature of the intermediate precipitator 4, by the addition of light and medium oils, in the gas reactor 6, in the event that optimum reaction conditions in the gas phase reactor requires this. Finally, the boiling fractions in the distillation 10 can be so adjusted that not only the amount of product, but also a solvent fraction (medium oil and, if such be the case, heavy oil with a lower boiling range) will pass through the gas phase reactor in order to obtain a desired quality of solvent (increased hydrogenated fraction).

Example 4

With reference to the numerical data in Example 2, the sump product from the intermediate precipitator 4 at 330°-340° C. consists of 70.5 kg of oils which still contain about 1.7 kg of light oil. By flash evaporating (depressurizing) the oils to atmospheric pressure, part of the oils evaporates, the vapor, however, being converted again into the liquid phase by condensation. The gases liberated when the oils are flash evaporated are carried away. The light oil (1.7 kg) is completely removed from the residual oil (solvent fraction 68.8 kg) in the distillation column 10 and conveyed via the pump 11 and the heater 5 to the charge for the gas phase hydrogenator. In this way, there is produced a solvent which is practically free of light oil.

Procedure (e)

Figure 4:
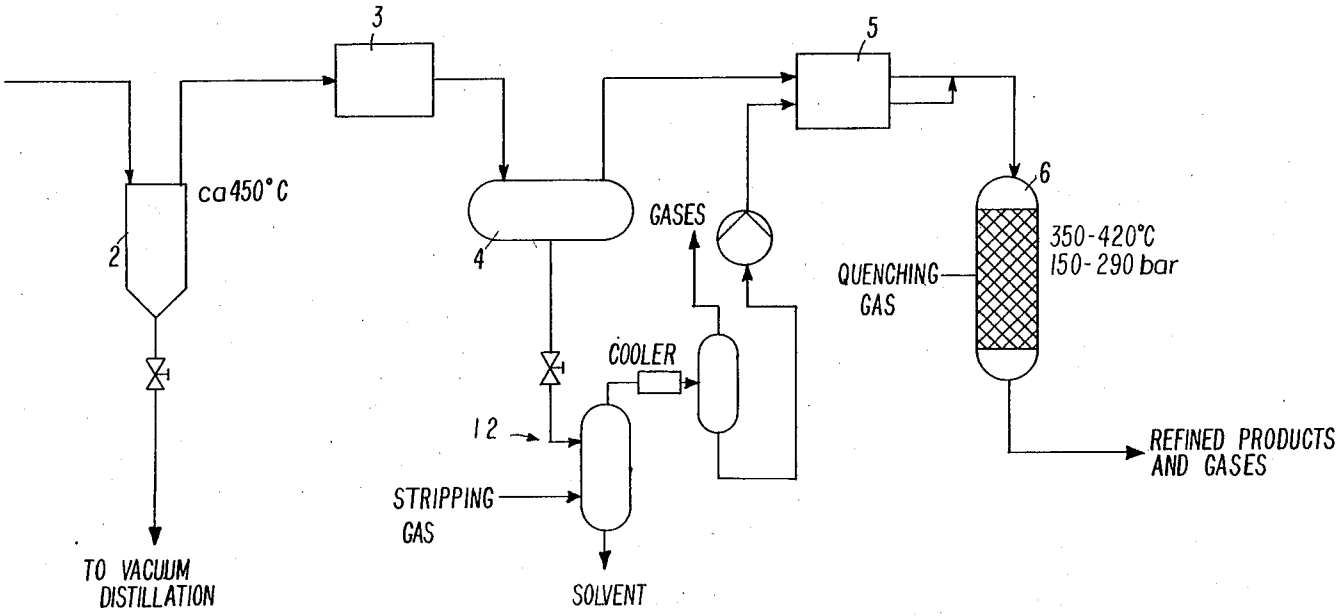
FIG. 4 is a flow diagram illustrating an alternative embodiment of the basic process of FIG. 3.

This procedure variant, illustrated in FIG. 4, is based on Procedure (d). By means of the flash evaporator (depressurizing evaporator) 12, the lighter fractions from the sump are separated. After condensing these lighter fractions and separating the gases, they are compressed under high pressure into the liquid phase, heated and added to the charge for the gas phase reactor. The separation of the lighter fractions in the flash evaporator 12 can, if need be, be enhanced by stripping.

Example 5

Based on the numerical date of Example 2, the sump product from intermediate precipitator 4 at 330°-340° C. consists of 70.5 kg of oils which still contain about 1.7 kg of light oil. By flash evaporating this oil to approximately atmospheric pressure in the flash evaporator 12, the oil is separated into 15.5 kg of oil vapor (1.5 kg light oil) and 55 kg of oils (0.2 kg light oil). The 15.5 kg of oil vapor along with 1.5 kg of light oil is condensed out, separated from the flash evaporation- and stripping gases, and conveyed via a high pressure pump 11 and heater 5 to the charge for the gas phase hydrogenator.

Procedure (f)

Figure 5:
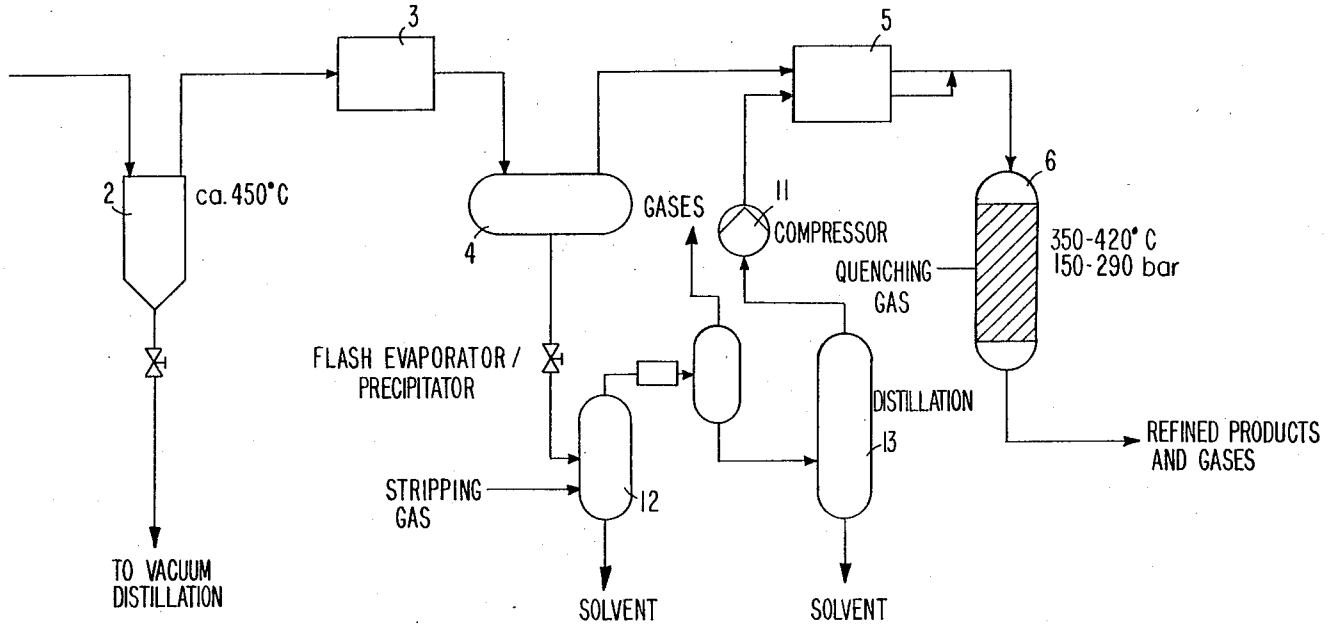
FIG. 5 is a flow diagram illustrating an additional alternative embodiment of the process of FIG. 3.

This procedural variant, illustrated in FIG. 5, constitutes a development of Procedure (e). By means of the flash evaporator 12—if need be with the support of stripping gas—the lighter fractions are separated from the sump. After condensing these lighter fractions and separating the gases, they are subdivided in a subsequent distillation 13 into a low boiling fraction which contains practically all the light oil, and a higher boiling fraction (solvent fraction). The lower boiling fraction is condensed at high pressure by means of the compressor 11, heated and added to the charge for the gas phase reactor.

Example 6

Based on the numerical date in Example 5, the 15.5 kg of oil vapors from the flash evaporator 12 consists of 1.5 kg of light oil and 14 kg of medium/heavy oil. In the subsequent distillation 13, the 1.5 kg of light oil are separated off, condensed, heated and added to the charge for the gas phase hydrogenator. The remaining 14 kg of medium/heavy oil are supplied to the solvent.

The invention, as described hereinabove in the context of a preferred embodiment, is not to be taken as limited to all of the provided details thereof, since modifications and variations thereof may be made without departing from the spirit and scope of the invention.

What is claimed is:

1. In a coal hydrogenation process in which the coal oils from the sump phase hydrogenation are subjected to a subsequent gas phase hydrogenation at a predetermined reaction temperature to obtain predetermined, refined products, an improvement to said process for producing an improved quality non-hydrogenated solvent for use in the coal mash of the sump phase hydrogenation (1) comprising the steps of:

separating products from the sump phase hydrogenation (1) into a sump product (liquid/solid phase) and a head product (gas/vapor phase) containing the coal oils in a hot precipitator (2) at a temperature of about 450° C., wherein about 70 percent of the heavy oil from the hot precipitator head product is obtained in vapor form;

partially cooling said head product of said hot precipitator in a heat exchanger (3) in order to condense from said head product a major portion of tendentiously high boiling fractions in the coal oils, wherein said head product is cooled to the predetermined reaction temperature of said subsequent gas phase hydrogenation;

subdividing the partially cooled head product of said hot precipitator by means of partial condensation in an intermediate precipitator (4) under process pressure into a higher boiling liquid fraction which is not hydrogenated and a lower boiling vapor-forming fraction comprising light and medium oils which are used as a charge for the gas phase hydrogenation (6);

maintaining said intermediate precipitator at a predetermined temperature corresponding to the reaction temperature of approximately 390° C. to 400° C. of the subsequent gas phase hydrogenation while subdividing the partially cooled head product of said hot precipitator;

passing said lower boiling vapor forming fraction consisting of hydrogenated gas and oil vapor to said subsequent gas phase hydrogenation (6); and drawing off said high boiling liquid fraction for use, at least in part, as the solvent to produce a coal mash in said coal hydrogenation process, whereby an improved quality solvent thus produced, consisting of the higher boiling intermediate precipitator sump product which is not hydrogenated, is obtained for the hydrogenating process.

2. The improved process in accordance with claim 1 wherein there is produced a hydrated solvent fraction which comprises medium-heavy oil, and wherein more coal oils are passed quantitatively through the gas phase reactor than correspond to the amount of product.

3. The improved process in accordance with claim 1 wherein there is produced a hydrated solvent fraction which comprises a mixture of medium-heavy oil and heavy oil with a low boiling point and wherein more coal oils are passed quantitatively through the gas phase reactor than correspond to the amount of product.

* * * * *